US005749508A

United States Patent [19]

Clothier

[11] Patent Number: 5,749,508

[45] Date of Patent: May 12, 1998

[54] NAILING GUN CARRIER

[76] Inventor: Darrell S. Clothier, 1985 Hwy 35, Kalispell, Mont. 59901

[21] Appl. No.: 610,206

[22] Filed: Mar. 4, 1996

[51] Int. Cl.[6] ..... B27F 7/02

[52] U.S. Cl. ..... 227/7; 227/8; 227/111

[58] Field of Search ..... 227/2, 7, 8, 5, 227/6, 110, 111, 156

[56] References Cited

U.S. PATENT DOCUMENTS

| | | | |
|---|---|---|---|
| 1,671,660 | 5/1928 | Vilneau et al. | 227/111 |
| 2,457,984 | 1/1949 | Dougherty | 227/111 |
| 3,173,593 | 3/1965 | Elliott | 227/111 |
| 3,771,708 | 11/1973 | De Nicola et al. | 227/111 |
| 3,796,365 | 3/1974 | Downing | 227/8 |
| 3,984,040 | 10/1976 | Fry | 227/7 |
| 4,084,197 | 4/1978 | Schneider | 227/7 |
| 4,265,387 | 5/1981 | Strouse | 227/7 |
| 4,523,706 | 6/1985 | Haley | 227/7 |
| 4,732,307 | 3/1988 | Hubbard et al. | 227/7 |
| 5,062,562 | 11/1991 | Michael | 227/111 |
| 5,381,597 | 1/1995 | Petrove | 227/111 |

*Primary Examiner*—Scott A. Smith

*Attorney, Agent, or Firm*—Harry M. Cross, Jr.

[57] ABSTRACT

A nailing gun carrier comprises a frame for carrying a nailing gun and moving the nailing gun along a surface to be nailed, a gun holder for attaching the nailing gun to the frame, and a gun firing assembly for positioning the nailing gun in proper position for firing a nail into the surface to be nailed. The gun firing assembly comprises a trigger-engaging arm positioned to depress a trigger of the nailing gun so as to cause the nailing gun to fire, a trigger safety release positioned to engage and release a trigger safety mechanism of the nailing gun to enable the gun to be fired, and a cam mechanism carried by the frame and operative to cycle the trigger-engaging arm between firing and non-firing modes and to cycle the trigger safety release between engaged and released modes so that the frame may be moved along the surface to be nailed and so that the nailing gun carried by the frame can be periodically fired to nail according to the cycles of the cam mechanism. The carrier frame includes a front wheel rotatably mounted to contact the surface to be nailed and to rotate as the frame in moved along the surface. The cam mechanism includes a cam mounted to the front wheel, and a cam follower configured to ride on a cam surface of the cam. The cam follower is carried by the frame for interacting with the trigger-engaging arm and the trigger safety release.

12 Claims, 6 Drawing Sheets

Fig. 3-B
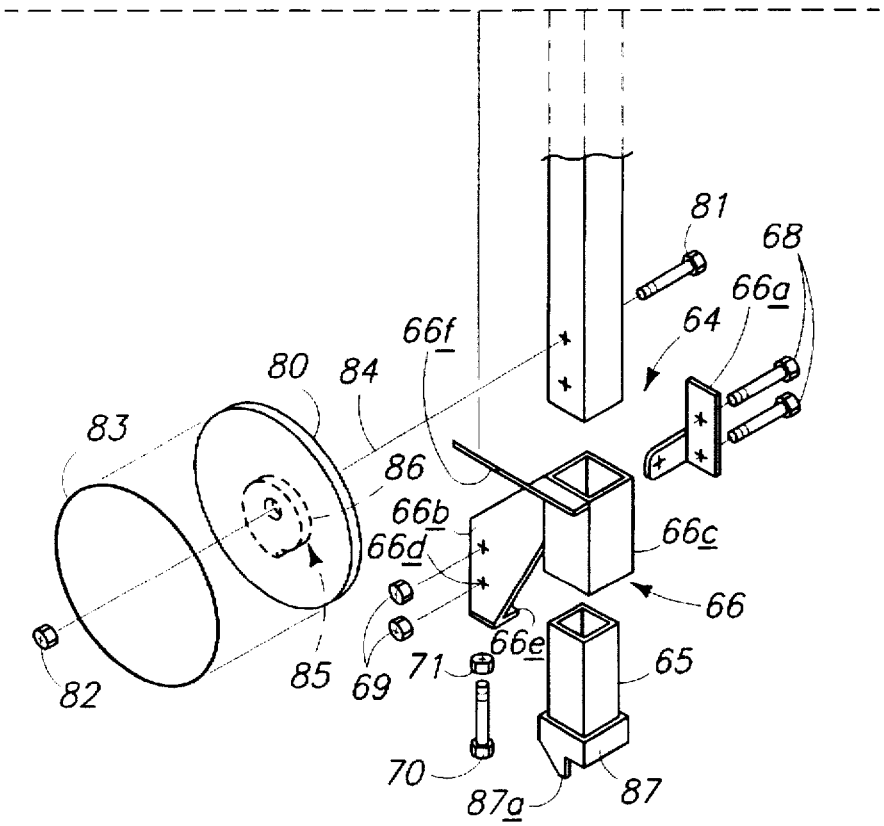

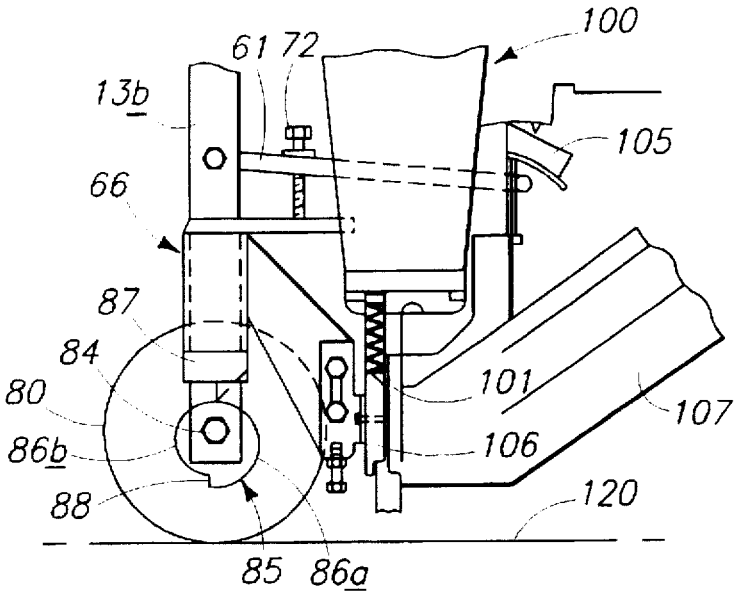
Fig. 4-A
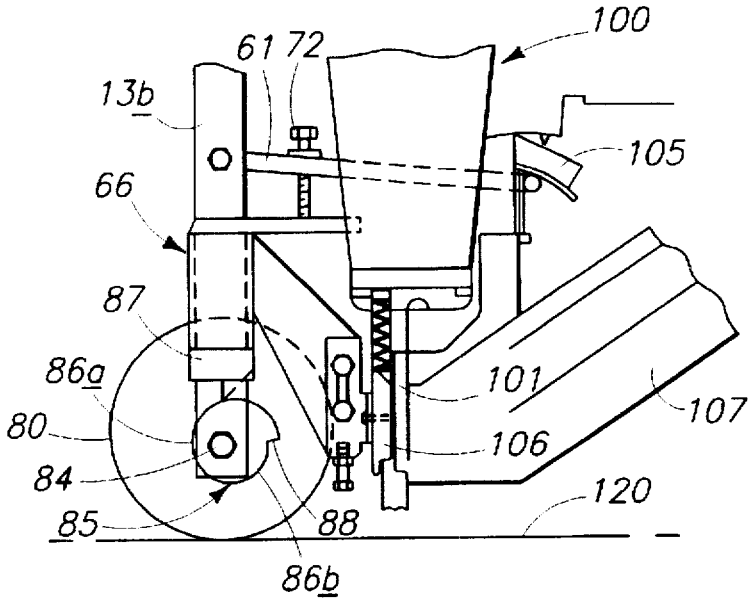
Fig. 4-B

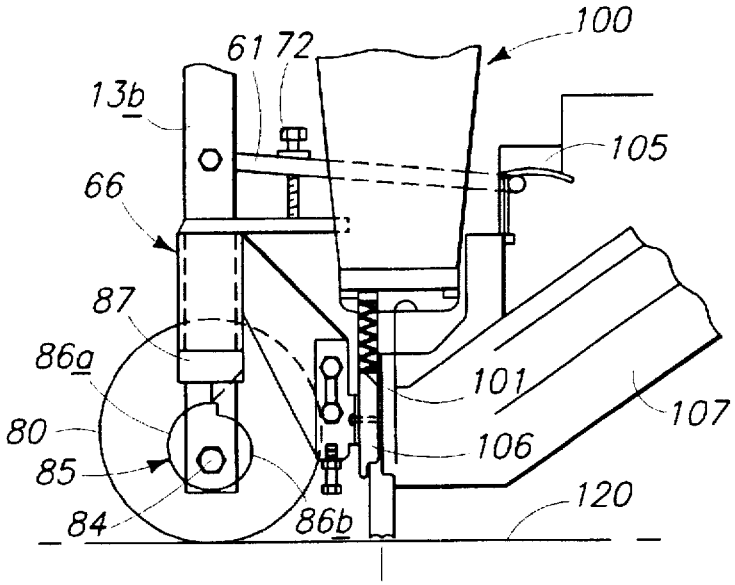
Fig. 4-C
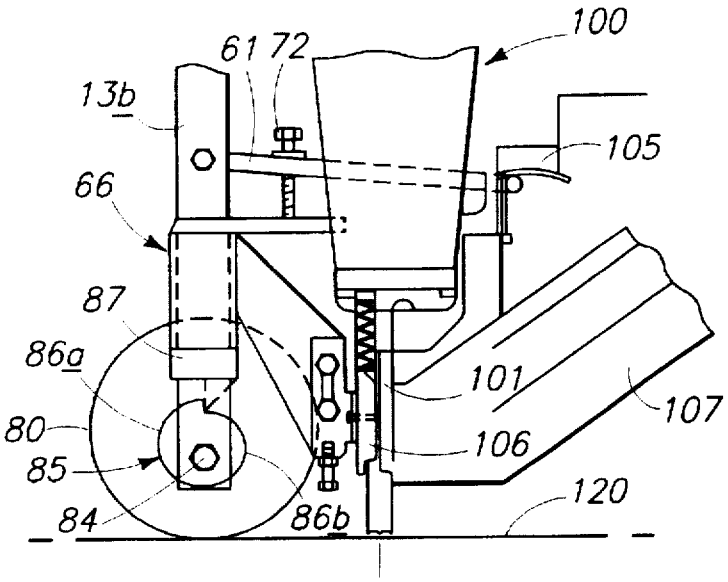
Fig. 4-D

NAILING GUN CARRIER

BACKGROUND OF THE INVENTION

1. Field of the Invention

This invention relates to carriers for portable, hand-operated pneumatic and electric nail and staple drivers.

2. Brief Description of the Prior Art

Portable hand-operated nail and staple drivers, commonly called "nailing guns" or "staple guns", used in the building trades are usually powered by compressed air, although they may be electrically powered. Typically, such drivers consist of a pneumatically or electrically operated driving mechanism housed in an elongated housing, a handle connected to the housing, and a nail or staple magazine connected to the housing for supplying nails or staples to the driving chamber of the device. The housing mounts a nail or staple discharge barrel into which a nail or a staple is fed from the magazine and through which the nail or staple must pass as it is fired into the work piece. Also typically, the handle mounts a finger-operable trigger mechanism that must be depressed to "fire" the device to discharge a nail or a staple through the discharge barrel into a work piece. Modern nail and staple drivers include a safety mechanism coupled to the driving mechanism and to the trigger mechanism so that safety mechanism must be disengaged before the trigger mechanism can be actuated to fire the driver.

Typical safety mechanisms include a safety sleeve or pin that reciprocates alongside the driver discharge barrel when the muzzle of the driver discharge barrel is forced against or removed from a work piece. The safety sleeve or pin is linked to a trigger block that normally prevents the trigger from being activated. The construction and arrangement of the safety mechanism is such that the trigger block is released when the safety sleeve or pin is retracted as a consequence of the discharge barrel muzzle being forced against the work piece. When the safety sleeve or pin is fully retracted, signifying that the muzzle of the driver discharge barrel is firmly planted against the work piece, the trigger is release and can be pressed to fire the driver. The safety sleeve or pin is spring-loaded to return to an extended position when the driver discharge barrel muzzle is lifted from the work piece. In order for the driver to be able to drive another nail or staple, the trigger must be released and the safety sleeve or pin must be extended to its original position with the driver discharge barrel muzzle lifted from the work piece. In a typical nailing or stapling operation, an operator would force the driver discharge barrel muzzle against the work piece and press the trigger to fire the driver, then release the trigger and lift the driver to reposition it to another nailing or stapling location. During the lifting and transferring operation, the driver would be lifted far enough away from the work piece to enable the safety sleeve or pin to fully extend. The operator would then force the driver discharge barrel muzzle to the work piece at the new location and press the trigger to fire the driver. The safety sleeve or pin is arranged with respect to the driver discharge barrel such that the trigger is released for firing only when the discharge barrel is forced into contact with the work piece. The return spring of the safety mechanism biases the safety sleeve or pin toward its normal extended position so that the operator must press the driver discharge barrel muzzle into contact with the work piece against the resistance of the bias of the return spring.

Several carriers have been proposed to carry a portable hand-operated nail or staple driver close to a work piece so that an operator could walk along a work piece and operate the driver without having to actually grip the driver with his or her hand. Such carriers are designed to eliminate the need for the operator to either crawl along the work piece or bend at the waist over the work piece. The object of such carriers is to reduce the wear and tear on the operator when engaging in repetitive nailing or stapling or work pieces such as subflooring, subroofing or the like by enabling the operator to stand erect and walk behind or alongside the driver. Some such carriers have been proposed that enable the automatic operation of a nail or staple driver, with the driver being automatically fired at predetermined spacings as the carrier is moved along a work piece. For one reason or another, such "walking" carriers have not found acceptance in the building trades. The heretofore proposed carriers may have been too costly to be widely affordable, to cumbersome to use on a variety of surfaces under a variety of conditions, limited to use with only a single style of driver or with only a custom driver tailored to the particular carrier.

SUMMARY OF THE INVENTION

It is a primary object of the present invention to provide an affordable walking carrier for a nailing or stapling driver that will automatically operate the driver at predetermined spacings. It is another object to provide such a carrier that can be used with different styles of drivers offered by different manufacturers, whether pneumatic or electric. A further object is to provide such a carrier that is easily and conveniently adaptable to alteration of the firing spacing. Still another object is to provide such a carrier with a framework and working components that can be fabricated from plastic or metal. A still further object is to provide such a carrier with a driver holder of a design that an off-the-shelf driver can be easily and conveniently installed and removed, so that a driver need not be dedicated to use only with the carrier. These and other objects and advantages will become apparent from the following drawings and description.

In accordance with these objects and advantages, the carrier of this invention comprises a nailing gun carrier which comprises a frame for carrying a nailing gun and moving the nailing gun along a surface to be nailed, a gun holder for attaching the nailing gun to the frame, and a gun firing assembly for positioning the nailing gun in proper position for firing a nail into the surface to be nailed. The gun firing assembly comprises a trigger-engaging arm positioned to depress a trigger of the nailing gun so as to cause the nailing gun to fire, a trigger safety release positioned to engage and release a trigger safety mechanism of the nailing gun to enable the gun to be fired, and a cam mechanism carried by the frame and operative to cycle the trigger-engaging arm between firing and non-firing modes and to cycle the trigger safety release between engaged and released modes so that the frame may be moved along the surface to be nailed and so that the nailing gun carried by the frame can be periodically fired to nail according to the cycles of the cam mechanism.

The carrier frame includes a front wheel rotatably mounted to contact the surface to be nailed and to rotate as the frame in moved along the surface. The cam mechanism includes a cam mounted to the front wheel, and a cam follower configured to ride on a cam surface of the cam. The cam follower is carried by the frame for interacting with the trigger-engaging arm and the trigger safety release. The cam mechanism includes an adapter slidably carried by the frame for reciprocable vertical movement in response to rotation of the cam. The cam follower is mounted to the adapter so as to cause the adapter to reciprocate as the cam rotates. The trigger-engaging arm contacts the adapter and is movable by the adapter between firing and non-firing modes in response to reciprocable movement of the adapter. The adapter is connected to the trigger safety release so as to cause the trigger safety release to move between engaged and released modes in response to reciprocable movement of the adapter.

BRIEF DESCRIPTION OF THE DRAWINGS

FIGS. 3A and 3B are an exploded view of the FIG. 1 carrier illustrating the various components of which the carrier is composed;

FIGS. 4A–D are fragmentary side elevation views of the bottom portion of the FIG. 1 carrier illustrating the sequence of operation of the carrier that effects an automatic operation of the nail or staple driver carried by the carrier.

DESCRIPTION OF THE PREFERRED EMBODIMENT

Figure 1:
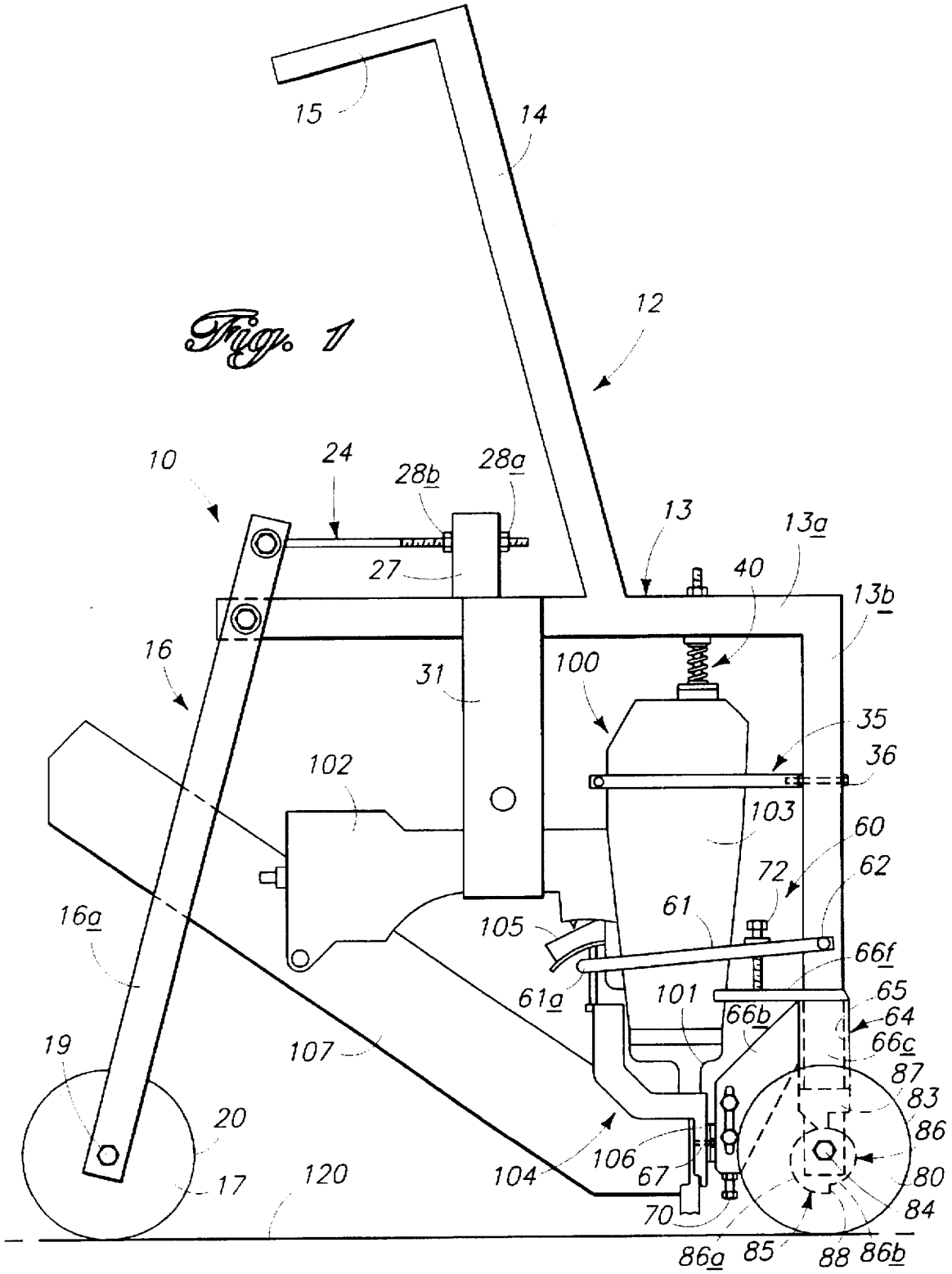
FIG. 1 is a side elevation view of the carrier of this invention as it would appear with a pneumatic nail or staple driver mounted therein.
Figure 2:
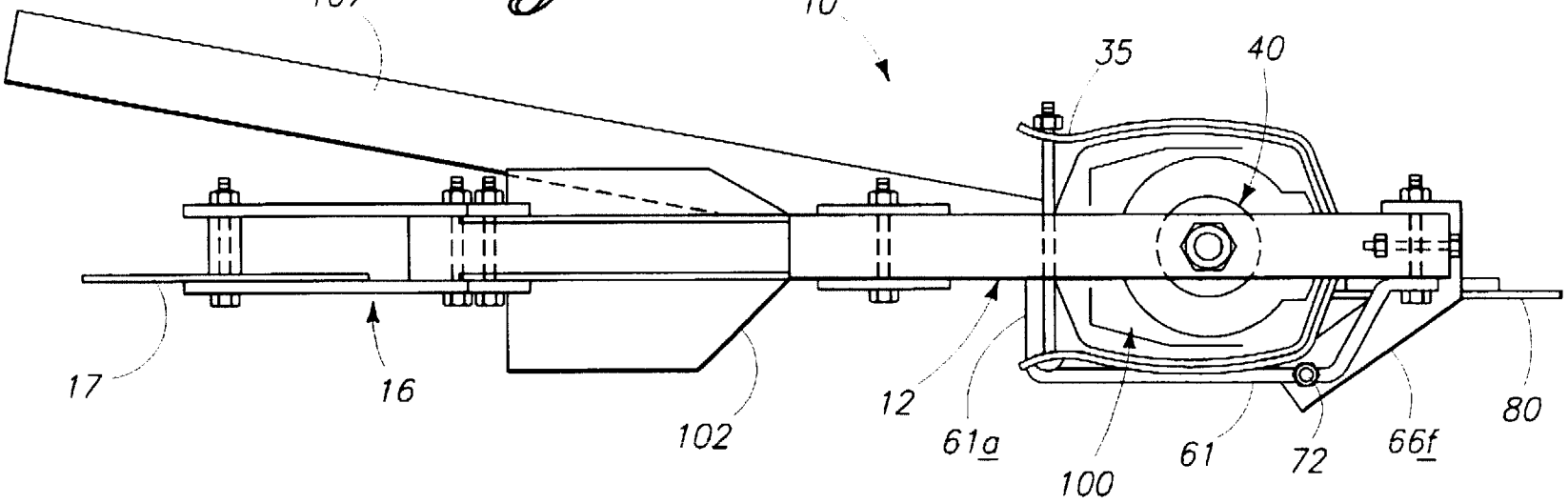
FIG. 2 is a top plan view of the FIG. 1 carrier.

In the following description and claims, the terms "nailing gun", "gun" are used to refer to a nail or staple driver, whether pneumatically or electrically operated. Some such drivers are designed for nailing, some for stapling, and some are convertible for use as either nail or staple drivers. The term "nailing gun" or "gun", therefore, is not limited but refers to a nail driver, or a staple driver, or to a driver that is convertible. Furthermore, the term "barrel" is used to refer to a "nailing gun's" nail or staple discharge structure that presents a muzzle port from which a nail or staple is drivingly ejected from the driver. The term "barrel", therefore, is not limited but refers to any assembly that receives nails or staples from the "gun's" supply magazine and guides the nail or staple as it is ejected from the "gun". The term "trigger" is used to refer to the driver component that is designed to be engaged by an operator to cause the "gun" to eject a nail or staple into a work piece. The term "fire" is used to designate the actuation of the "gun", causing it to eject a nail or a staple into a work piece. The term "safety actuator" is used to refer to the driver component that moves with respect to the "gun's" "barrel" for releasing the "trigger" so that the "trigger" can be engaged to "fire" the "gun". A "safety actuator" may be a safety sleeve or pin that reciprocates alongside the "barrel" or some other element. Therefore, "nailing gun", "gun", "barrel", "trigger", "fire" and "safety actuator" are simplifying terms used to simplify the description and are not terms of limitation.

The carrier 10 of this invention is designed to hold an off-the-shelf nailing gun 100 with the nailing gun's barrel 101 oriented downward so that the gun's nails can be fired into subflooring or subroofing or some other material over which the carrier 10 can be moved. The carrier 10 comprises a frame assembly 12, a gun holder assembly 30, and a gun firing assembly 60.

Frame assembly 12 comprises a primary gun support member 13 having a horizontal leg **13*a* and a depending vertical leg 13*b* that extends downward from leg 13*a* at the front of the frame assembly. A handle support 14 is attached to leg 13*a* and extends upward and rearward from leg 13*a* at an acute angle. A handle 15 is attached to the upper end of the handle support and extends rearward perpendicular to the handle support. Members 13, 14 and 15 may be fabricated of square tubing, such as 1 inch square tubing, from plastic or metal. If members 13, 14 and 15 are fabricated from plastic, they could be molded as one piece. If members 13, 14 and 15** are fabricated from metal, they could be welded together and the weld joints ground so that the members would appear to be of one piece construction when painted.

Frame assembly 12 also comprises a rear wheel support 16 in the form of two wheel legs **16*a*, 16*b* that are attached at their upper ends to the rear end of leg 13*a*, one on either side of leg 13*a* so that the wheel legs 16*a*, 16*b* are spaced apart. At the lower ends of the wheel legs, a circular rear wheel 17 is positioned between the wheel legs by a short tubular spacer 18. A machine bolt 19 extends through appropriate bores in the wheel legs 16*a*, 16*b* and through the spacer 18. A lock nut 20 is threaded onto the bolt to secure the rear wheel in place. Spacer 18 positions the rear wheel 17 so that it is aligned with the front wheel 80. The wheel legs 16*a*, 16*b* may be fabricated of thin bar stock from plastic or metal. Rear wheel 17 may be fabricated from plastic or metal. If wheel 17 is fabricated from plastic, the periphery may be grooved so as to receive and hold an O-ring tire 21, tire 21 being fabricated from a flexible material such as a synthetic elastomer or plastic. The provision of the O-ring tire 21 enhances the traction of wheel 17 so that it will roll, not slide, along a surface. The rear wheel legs 16*a*, 16*b* may be pivotably fasted to the rear end of leg 13*a* by a machine bolt 22 that extends through appropriate bores in legs 13*a* and 16*a*, 16*b*. A lock nut 23 is threaded onto the bolt in place and would preferably be tightened only to the point to secure the bolt in place so that the wheel legs 16*a*, 16*b* could freely pivot. An adjustable link 24 could be pivotably fastened to the upper ends of the wheel legs 16*a*, 16*b*, outward of the pivot connection provided by bolt 22. A suitable configuration for link 24 would include a transverse tube 24*a* and an elongated threaded shank 24*b*. A machine bolt 25 extends through tube 24*a* and through appropriate bores in wheel legs 16*a*, 16*b* and is secured in place by a lock nut 26. The threaded end of shank 24*b* extends through an fastening bracket 27 on frame assembly gun support leg 13*a* and is fastened in position by front and rear nuts 28*a*, 28*b* that are threaded onto shank 24*b* on either side of bracket 27. Link 24 may be fabricated from plastic or metal. If link 24** is fabricated from plastic it could be molded in one piece.

The angular position of the rear wheel legs, relative to horizontal leg **13*a*, may be adjusted by loosening the nuts 28*a*, 28*b*,so that link 24 can be effectively lengthened or shortened, and then tightening the nuts 28*a*, 28*b* against the bracket 27. By adjusting the angular position of the rear wheel legs, the rear end of the frame assembly may be raised and lowered. Consequently, for any diameter of the front wheel 80, the frame assembly 12 can be adjusted so that the nailing gun 100** will be properly oriented to function in the manner described in a later section.

The gun holder assembly 30 comprises a pair of gun handle attachment arms 31, 32 that are fastened to the gun support horizontal leg **13*a* and depend vertically downward therefrom. The lower ends of arms 31, 32 are curved inward at 31*a*, 32*a* to provide support for the gun handle 102. Arms 31, 32 are fastened to either side of leg 13*a* so that they are spaced apart. The lower ends of the arms are provided with appropriate bores at an elevation just above the top of gun handle 102 so that a machine bolt 33 can be extended through the bores and secured therein by a nut 34. By tightening nut 34, the arms 31, 32 can be drawn together to clamp the gun handle 102 between then. Arms 31, 32** can be fabricated from plastic or metal.

The gun holder assembly also comprises a gun body holding bracket 35. Bracket 35 is configured to extend around the front and both sides of gun support vertical leg 13*b* and to be fastened to leg 13*a* by a machine bolt 36. Leg 13*b* is appropriately bored to receive bolt 36. Bolt 36 is secured by a nut 37. Bracket 35 is also configured to extend around both sides of the gun body 103 and to be fastened thereto by a machine bolt 38. Bolt 36 extends through appropriate bores in the ends of bracket 35 and is fastened in place by nut 39. When bracket 35 is tightened around the gun body 103, and arms 31, 32 are clamped against the gun handle 102, the gun 100 is securely mounted to the frame assembly 12. The arms 31, 32 and bracket 35 are configured to position the gun 100 so that the gun barrel 101 is oriented vertically downward, parallel to vertical leg 13*b*. Arms 31, 32 and bracket 35 may be fabricated from plastic or metal.

The gun holder assembly 30 also includes a recoil subassembly 40. The recoil subassembly comprises a recoil dampening pad 41 mounted on the bottom surface of a recoil disk 42. Disk 42 is mounted at the bottom end of a threaded shaft 43 that is extended through an appropriate vertical bore in support leg 13*a* and through a coil compression spring 44. Spring 44 bears against the disk 42 and the underside of the support leg 13*a*. Disk 42 and its recoil pad 41 are secured in place firmly against the upper end of gun body 103 by a nut 45 that is permanently fastened to the top of support leg 13*a*.

The gun firing assembly 60 is designed to release the gun's trigger safety mechanism 104 and depress the gun's trigger 105 as the gun-mounted carrier 10 is rolled along a surface to be nailed or stapled. The gun firing assembly comprises a trigger-engaging arm 61 that is pivotably connected to support vertical leg 13*b* by a machine bolt 62 that extends through appropriate bores in arm 61 and leg 13*a* and is fastened by nut 63 so that arm 61 freely pivots about bolt 62. Arm 61 is located at an elevation suitable for its outer end 61*a* to be swung upward into contact with the gun's trigger 105. Assembly 60 also comprises trigger safety release 64 that is attached to the gun's safety actuator 106.

The trigger safety release 64 comprises a tubular slide 65 having an inner tubular configuration to enclose and slide up and down on support vertical leg 13*b*. Release 64 also comprises a mounting two-part adapter bracket 66 carried by slide 65 and extended rearward for attachment to the gun's safety actuator 106. Bracket 66 comprises a first adapter member 66*a* that is attached to the safety actuator 106 by a machine screw 67 that is extended through an appropriate bore in member 66*a* and is threaded into the front of safety actuator 106. Bracket 66 also includes a second adapter member 66*b* that is either integral to, or permanently attached to a sleeve 66*c*, sleeve 66*c* being carried by slide 65. Member 66*b* is provided with a vertical adjustment slot 66*d*. A pair of bolts 68 extend through appropriate bores in the first adapter member 66*a* and through the slot 66*d* to join the two adapter members together. A pair of nuts 69 secures the two adapter members together. Because of the vertical slot 66*d*, the relative vertical positions of the two adapter members 66*a*, 66*b* can be adjusted to suit the physical requirements of the particular gun 100 that is mounted in the carrier 10. The second adapter member 66*b* is provided with a bottom tab 66*e* through which an elevation-adjusting bolt 70 can be extended into abutment with the bottom edge of the first adapter member 66*a*. A nut 71 is attached to bottom tab 66*e* so that bolt 70 can be threaded upward or downward with the upper end of bolt 70 providing an adjustment surface to control the elevation of the first adapter member 66*a* relative to the second adapter member 66*b*. A trigger arm actuating lever 66*f* extends rearward from the top of sleeve 66*c*. The two members of bracket 66 and slide 65 may be fabricated from plastic or metal.

The first adapter member 66*a* will be configured to be attached to the safety actuator 106. For some guns, such as a staple gun, the safety actuator may be configured as foot, and the first adapter member 66*a* must be configured to interfit with the foot so as to effect a release of the gun's safety mechanism as described in a later section. By providing the adapter bracket 66 in two parts, the second adapter member 66*b* can usually be fitted to most any gun configuration. Therefore, the first adapter member 66*a* can be tailored to suit a particular gun configuration and particular safety actuator configuration. Consequently, the adapter bracket 66 need only be modified in respect of the first adapter bracket to suit a variety of gun configurations.

The frame assembly 12 also comprises a front wheel 80 that is rotatably mounted to the lower end of support vertical leg 13*b* by a bolt 81 that extends through an appropriate bore in the end of leg 13*b* and a nut 82. As with rear wheel 17, the front wheel 80 may be fabricated of plastic or metal and, if of plastic, the wheel periphery may be provided with a rim groove for an O-ring tire 83. Front wheel 80 is also a key component of the gun firing assembly 60. Front wheel 80 is circular but is mounted for rotation on bolt 81 on eccentric axis. Consequently, as the carrier 10 is moved along a surface 120, with wheels 17 and 80 rolling along the surface 120, the front of the carrier 10 will rise and fall as the front wheel's eccentric axis 84 rises and falls.

The gun firing assembly 60 also includes a disk cam 85 provided on the inside surface of front wheel 80. The periphery 86 of cam 85 provides an arcuate cam surface that has a varying radius with respect to the eccentric axis 84. Slide 65 carries a cam follower 87 having a tip 87*a* that rides on the cam surface 86 of cam 85. The radius of the cam surface 86 varies from a relatively small radius that coincides with the shortest distance from eccentric axis 84 to the periphery of front wheel 80, to a relatively large radius that coincides with the longest distance from eccentric axis 84 to the periphery of front wheel 80. Thus, the arcuate cam surface 86 is somewhat elliptical. At its point of greatest radius, the cam surface 86 is stepped radially inward at 88 so that it has a first arcuate cam surface 86*a* that extends in one direction from the point of smallest radius, and a second arcuate cam surface 86*b* that extends in the other direction from the point of smallest radius, the two surfaces 86*a*, 86*b* being separated by the step 88. The two cam surfaces 86*a*, 86*b* are oriented such that the cam follower tip 87*a* will ride along the first cam surface 86*a*, drop off the step 88, and then ride along the second cam surface 86*b* to the point of beginning.

Because of the relationship between the cam surface 86 and the eccentric periphery of front wheel 80, the cam follower tip 87*a* will cause the slide 65 to reciprocate upward on support vertical leg 13*b* as vertical leg 13*b* is lowered toward the rolling surface 120. At the point that vertical leg 13*b* is closest to the rolling surface 120, as illustrated in FIG. 4C, the cam follower tip 87*a* will be at the step 88 and the slide 85 will be at its highest elevation on vertical leg 13*b*. It is at this position that the gun 100 is fired. In order for this to occur, the trigger safety mechanism 104 must have released the trigger 105 so that is can be depressed to fire the gun. Due to the rigid structure of the adapter bracket 66, as slide 65 is moved upward on vertical leg 13*b*, the safety actuator 106, to which bracket 66 is attached, is moved upward. Cam surface 86*a* is configured so that safety actuator 106 will be moved upward a sufficient distance to release the trigger 105 for firing.

An adjustment bolt 72 is extended down through a bore appropriately provided in trigger-engaging arm 61 into contact with trigger arm actuating lever 66*f*. Bolt 72 is threaded through a nut 73 attached to the arm 61 so that the length of the protrusion of bolt 72 below arm 61 can be varied. Bolt 72 is adjusted so that the trigger arm actuating lever 66*f* will contact arm 61 and pivot arm 61 upward as the adapter 66 is moved upward. Therefore, as slide 65 is moved upward under the action of cam surface 86*a* operating on cam follower tip 87*a*, the trigger-engaging arm 61 will pivot upward to depress the gun's trigger 105, also as illustrated in FIG. 4C.

The twin operations of releasing the trigger for firing, as a result of lifting the safety actuator 106 through adapter 66, and depressing the trigger to fire the gun, as a result of pivoting the trigger-engaging arm 61 upward against the trigger, all occur as the cam follower tip 87*a* is raised upward as the first cam surface 86*a* revolves around the front wheel's eccentric axis 84. Simultaneous with this action, the gun's barrel 101 is lowered so that its muzzle is placed adjacent to the rolling surface 120, also as illustrated in FIG. 4C, as a result of the elevation of the front wheel's eccentric axis 84 being lowered toward surface 120.

When the gun fires, continued rotation of the front wheel 80 will cause cam follower tip 87*a* to drop off the step 88 down onto the second cam surface 87*b*. As a result of the drop off, the slide 65 will drop the height of the step 88, thereby causing the trigger-engaging arm 61 to pivot downward from the gun's trigger 101, as illustrated in FIG. 4D, thereby allowing the trigger mechanism to reset and the gun to recharge for the next firing. As the front wheel 80 continues to rotate, the cam follower tip 87*a* will track along the reducing radius second cam surface 86*b* permitting the downwardly-biased trigger safety actuator 106 to drop so as to effect actuate the trigger safety mechanism 104 to prevent premature firing of the gun. Continued rotation of the front wheel 80 raises the elevation of the front wheel eccentric axis 84, thereby raising the gun barrel off of the surface 120, as illustrated in FIG. 4A. As the carrier 10 continues to move forward, the slide 65 begins to move upward so that the trigger-engaging arm 61 pivots up into contact with the trigger 105, and the eccentric axis lowers toward the surface 120 to bring the gun's barrel muzzle toward the surface again, as illustrated in FIG. 4B.

Figure 3:
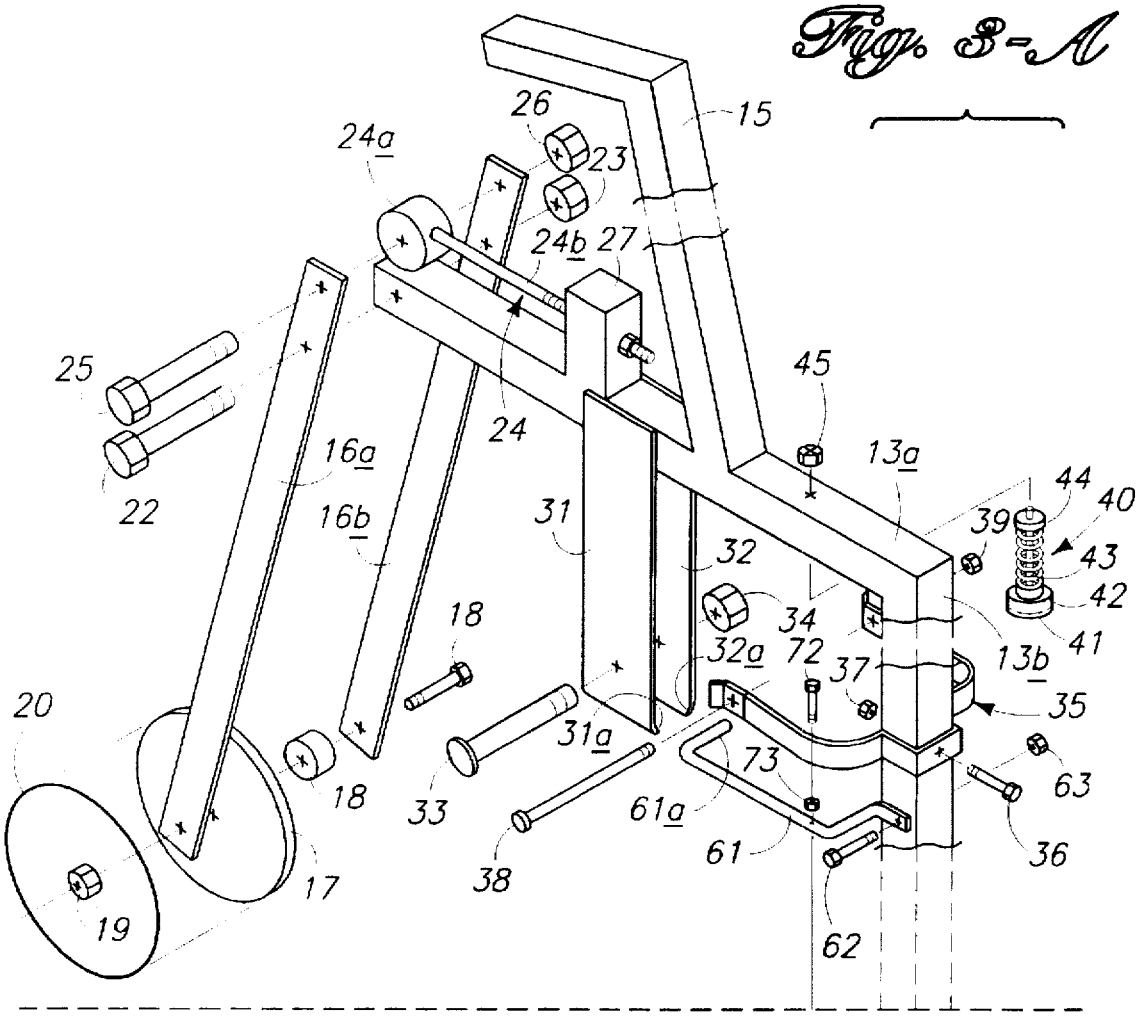
FIG. 3 is a diagram of the relationship between FIGS. 3A and 3B.

The peripheral length of the front wheel 80 determines the distance between gun firings. If a greater distance is desired, a larger diameter front wheel can be installed. The lower end of the support vertical leg 13*b* could be provided with two or more transverse bores for the front wheel axle bolt 81 so that relationship of the cam surface 86 to the cam follower 87 will not be disrupted by changing the front wheel diameter. Therefore, the same cam size and configuration can be employed for different front wheel diameters by appropriate location of the vertical leg bores for the front wheel axle bolt 81. FIG. 3 illustrates the provision of two such vertical leg bores.

When the gun is fired, the muzzle of gun barrel 101 should be contacting the surface to be nailed or stapled. For any front wheel diameter and gun configuration, the rear wheel support 16 can be angularly adjusted through adjustable link 24 to position the frame assembly 12 properly so that the muzzle will contact the surface to be nailed at the point where the gun is fired. For any given front wheel and gun configuration, pivoting the rear wheel support legs 16*a*, 16*b* forward about bolt 22 will lift the gun muzzle up, and pivoting the rear wheel support legs rearward will lower the gun muzzle.

The carrier 10 is illustrated as having one rear wheel 17, with the gun's nail or staple magazine 107 extending alongside the rear wheel support 16. The provision of one rear wheel enables the operator to change the orientation of the carrier 10 relative to the plane of the surface 120. Thus, for example, if the surface 120 were sloped, as it might be if it was on a roof, the operator, could tip the carrier 10 to keep the carrier in a vertical plane as he moved the carrier across the surface. In some situations, it might be desirable to provide the carrier with two rear wheels, in which case two rear wheel supports would be provided, and the two rear wheels might be mounted on a common axle. In the case of a two rear wheeled carrier, the gun's magazine could extend between the rear wheels.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A nailing gun carrier which comprises a frame for carrying a nailing gun and moving the nailing gun along a surface to be nailed; a gun holder for attaching the nailing gun to said frame; and a gun firing assembly for positioning the nailing gun in proper position for firing a nail into the surface to be nailed, said gun firing assembly comprising a trigger-engaging arm positioned to depress a trigger of the nailing gun so as to cause the nailing gun to fire, a trigger safety release positioned to engage and release a trigger safety mechanism of the nailing gun to enable the gun to be fired, and a cam mechanism carried by said frame and operative to cycle said trigger-engaging arm between firing and non-firing modes and to cycle said trigger safety release between engaged and released modes so that said frame may be moved along the surface to be nailed and so that the nailing gun carried by said frame can be periodically fired to nail according to the cycles of said cam mechanism.

2. The carrier of claim 1 wherein said frame includes a front wheel rotatably mounted to contact the surface to be nailed and to rotate as said frame in moved along the surface; and wherein said cam mechanism includes a cam mounted to said front wheel, and a cam follower configured to ride on a cam surface of said cam, said cam follower being carried by said frame for interacting with said trigger-engaging arm and said trigger safety release.

3. The carrier of claim 2 wherein said cam mechanism includes an adapter slidably carried by said frame for reciprocable vertical movement in response to rotation of said cam; wherein said cam follower is mounted to said adapter so as to cause said adapter to reciprocate as said cam rotates; wherein said trigger-engaging arm contacts said adapter and is movable by said adapter between firing and non-firing modes in response to reciprocable movement of said adapter; and wherein said adapter is connected to said trigger safety release so as to cause said trigger safety release to move between engaged and released modes in response to reciprocable movement of said adapter.

4. The carrier of claim 3 wherein said front wheel is mounted for rotation about an eccentric axis so that the gun carried by said frame will be raised and lowered as said front wheel revolves about said eccentric axis; and wherein said cam is so configured that said cam mechanism will cause said trigger engaging arm to move to a firing mode and said trigger safety release to move to a released mode when said eccentric axis is closest to the surface to be nailed.

5. The carrier of claim 4 wherein said carrier includes a rear wheel support pivotable mounted to said frame, and a rear wheel rotatably mounted to said rear wheel support to contact the surface to be nailed, said rear wheel support being adjustable relative to said frame so that a barrel muzzle of the nailing gun can be adjusted relative to the surface to be nailed.

6. The carrier of claim 5 wherein said frame includes a handle located at an elevation whereby an operator can grip said handle and push said frame along the surface to be nailed.

7. The carrier of claim 3 wherein said carrier includes a rear wheel support pivotable mounted to said frame, and a rear wheel rotatably mounted to said rear wheel support to contact the surface to be nailed, said rear wheel support being adjustable relative to said frame so that a barrel muzzle of the nailing gun can be adjusted relative to the surface to be nailed.

8. The carrier of claim 2 wherein said front wheel is mounted for rotation about an eccentric axis so that the gun carried by said frame will be raised and lowered as said front wheel revolves about said eccentric axis; and wherein said cam is so configured that said cam mechanism will cause said trigger engaging arm to move to a firing mode and said trigger safety release to move to a released mode when said eccentric axis is closest to the surface to be nailed.

9. The carrier of claim 8 wherein said carrier includes a rear wheel support pivotable mounted to said frame, and a rear wheel rotatably mounted to said rear wheel support to contact the surface to be nailed, said rear wheel support being adjustable relative to said frame so that a barrel muzzle of the nailing gun can be adjusted relative to the surface to be nailed.

10. The carrier of claim 2 wherein said carrier includes a rear wheel support pivotable mounted to said frame, and a rear wheel rotatably mounted to said rear wheel support to contact the surface to be nailed, said rear wheel support being adjustable relative to said frame so that a barrel muzzle of the nailing gun can be adjusted relative to the surface to be nailed.

11. The carrier of claim 1 wherein said carrier includes a rear wheel support pivotable mounted to said frame, and a rear wheel rotatably mounted to said rear wheel support to contact the surface to be nailed, said rear wheel support being adjustable relative to said frame so that a barrel muzzle of the nailing gun can be adjusted relative to the surface to be nailed.

12. The carrier of claim 1 wherein said frame includes a handle located at an elevation whereby an operator can grip said handle and push said frame along the surface to be nailed.

* * * * *